United States Patent [19]

Johnson

[11] Patent Number: 4,497,308

[45] Date of Patent: Feb. 5, 1985

[54] ASH RECEPTACLE WITH DUST ELIMINATOR

[76] Inventor: Robert R. Johnson, 424-4th SE., Pacific, Wash. 98047

[21] Appl. No.: 536,943

[22] Filed: Sep. 27, 1983

[51] Int. Cl.[3] ..... F23J 1/00

[52] U.S. Cl. ..... 126/242; 126/243; 110/165 R; 15/327 F

[58] Field of Search ..... 126/242, 243, 244, 245; 15/327 F; 110/165 R

[56] References Cited

U.S. PATENT DOCUMENTS

| | | | |
|---|---|---|---|
| 2,304 | 7/1866 | Lawson | 126/243 |
| 1,065,953 | 7/1913 | May . | |
| 1,166,506 | 1/1916 | Widdrington . | |
| 1,315,259 | 9/1919 | Swanson | 126/243 |
| 1,322,361 | 11/1919 | Sherman | 126/242 |
| 1,355,508 | 10/1920 | Roever | 126/242 |
| 1,372,539 | 3/1921 | Osburn . | |
| 1,423,352 | 7/1922 | Milholen | 126/243 |
| 1,438,719 | 12/1922 | Peffer . | |
| 1,478,804 | 12/1923 | Toricelli | 126/243 |
| 1,533,777 | 4/1925 | Walker, Jr. . | |
| 1,535,637 | 4/1925 | Venetz | 126/242 |
| 1,611,018 | 12/1926 | Fuller . | |
| 1,629,336 | 5/1927 | Clements | 126/243 |
| 1,661,306 | 3/1928 | Rogers . | |
| 1,887,768 | 11/1932 | Maloney . | |
| 1,957,379 | 5/1934 | App | 126/243 |
| 2,013,498 | 9/1935 | McConaughy | 126/242 |
| 2,529,965 | 11/1950 | Rentz | 126/242 |
| 2,539,257 | 1/1951 | Limberg | 15/327 F |
| 3,416,514 | 12/1968 | Klemme | 126/242 |
| 3,618,297 | 11/1971 | Hamrick | 15/327 F |
| 3,636,681 | 1/1972 | Batson | 15/327 F |

*Primary Examiner*—Larry Jones

*Attorney, Agent, or Firm*—Delbert J. Barnard

[57] ABSTRACT

A filter member (98) is mounted on the inside of a sidewall (16) of a receptacle (10), in a position covering an opening (76) in the sidewall (16). A vacuum cleaner suction hose attachment (122) is provided on the opposite side of such opening (76). The receptacle (10) is a closed container when used, except for a sidewall inlet (38) in the sidewall (14) which is opposite the filter carrying wall (16). Ashes (134) are introduced into the inlet opening (38) and dumped into an ash pan (52) contained within the lower portion of the receptacle (10). The vacuum cleaner (130) draws the fine dust to the filter member (98). The fine ash dust is collected by the filter member (98) or is drawn into the vacuum cleaner (130). When the ash pan (52) needs to be emptied, the top (22) of the receptacle (10) is swung open. The attendant sticks his or her hand down into the receptacle (10) and grabs a handle portion (64) of the dust pan (52), moves such handle (64) from a folded down position up into an upright position and uses it for removing the ash pan (52) out from the receptacle (10).

5 Claims, 4 Drawing Figures

10
22
26
28
30
36
34
24
62
74
68
64
56
52
72
60
54
66
56
70
54
88
102
112
114
106
122
120
118
116
108
104
100
98
94
92
96
84
16
86
76
78
82
90
80
38
42
46
12
40
18
14

ASH RECEPTACLE WITH DUST ELIMINATOR

DESCRIPTION

1. Technical Field

The present invention relates to the provision of an ash receiving receptacle of a type having an improved dust eliminator which utilizes suction provided by a conventional home vacuum cleaner.

2. Background Art

Broadly speaking, the idea of providing an ash receptacle with some sort of system for eliminating dust from the air while depositing ashes into the receptacle is not a new idea. By way of example, U.S. Pat. No. 1,065,953, granted July 1, 1913, to William H. May, discloses a square box-like receptacle in which ashes are introduced via a side door. A conduit is provided which extends from the top of the receptacle to a hood which is insertable into the open door of a furnace. The natural draft of the furnace is used for pulling the dust or fine ashes out from the receptacle.

U.S. Pat. No. 2,529,965, granted Nov. 14, 1950, to Cecil V. Rentz, relates to an ash can having a top opening into which the ashes are introduced. One half of the ash can is covered and such cover mounts a suction device. The suction device functions to pull the fine ash dust out from the receptacle and blow it through a conduit which is adapted to discharge the dust into an open door of a furnace so that the dust will pass up through the flue of the furnace.

Other ash receiving receptacles which are equipped with some sort of ash dust eliminator are shown by the following U.S. Pat. No. 1,166,506, granted Jan. 4, 1916, to William P. Widdrington; No. 1,372,539, granted Mar. 22, 1921, to John A. Osburn; No. 1,438,719, granted Dec. 12, 1922, to Arthur W. Peffer; No. 1,533,777, granted Apr. 14, 1925, to Hobart A. Walker, Jr.; No. 1,611,018, granted Dec. 14, 1926, to Walter E. Fuller; No. 1,661,306, granted Mar. 6, 1928, to Robert W. Rogers; No. 1,887,768, granted Nov. 15, 1932, to Andrew J. Maloney; and No. 3,416,514, granted Dec. 17, 1968, to William R. Klemme.

None of the devices disclosed by these patents provides a satisfactory way of collecting ashes from the fireplaces and stoves which are in use today.

The principal object of the present invention is to provide an ash collector box which the user can store next to, or in the general vicinity of, a fireplace or stove. Then, when the ash collector is to be used, a conventional home vacuum cleaner is positioned adjacent the receptacle, the accessory hose for the vacuum cleaner is easily and quickly attached to a fitting which is carried by the receptacle, and the vacuum cleaner is used for providing a suction for drawing the ash dust to a filter which is mounted inside the ash collecting receptacle.

DISCLOSURE OF THE INVENTION

In accordance with the present invention, a receptacle is provided which has a top which is closed during use of the receptacle. Ashes are picked up from the stove or fireplace by means of a small shovel and are then introduced into an inlet opening which is provided on one side of the receptacle. A wall of the receptacle, preferably the wall opposite the inlet opening, is provided with a mounting for a dust collecting filter. The filter is located in line with an opening through the sidewall. The opposite side of such sidewall mounts a tubular fitting having a nipple which is telescopically engageable with a socket-like fitting at the inlet end of an accessory hose for a conventional home vacuum cleaner. The vacuum cleaner provides a suction which serves to draw the ash dust to the filter. Some of the dust passes through the filter and is drawn into the vacuum cleaner bag. However, a substantial portion of the ash dust is collected in the filter.

Preferably, the filter is in the nature of a rectangular block of fibrous material which is insertable into a filter holder which is carried by the receptacle sidewall.

In preferred form, the filter holder is a three sided structure designed to receive and retain edge portions of the filter block.

Preferably also, an adaptor mount is provided on the sidewall of the receptacle immediately opposite the filter block holder. A mounting plate portion of the adaptor is easily inserted into and removable out from the adaptor holder. When the adaptor is positioned within the holder, it includes a tubular nipple which projects laterally outwardly from the sidewall of the receptacle. The inner end of the nipple is in axial alignment with an opening in the sidewall and such opening is covered by the filter block.

In accordance with another aspect of the invention, the receptacle includes a top cover which is hinged along one edge so that it can be swung upwardly to open the top of the receptacle when it is desired to remove the collected ashes from the receptacle. An ash collector pan sits down on the floor of the receptacle. The ash collector pan includes a handle for use in setting the ash pan into and removing it out from the receptacle.

Other features of the invention are more specifically described in the detailed description of the preferred embodiment and are particularly pointed out and distinctly claimed in the appended claims. Accordingly, the detailed description of the preferred embodiment and the appended claims constitute portions of the description of the invention.

BRIEF DESCRIPTION OF THE DRAWING

In the drawing, like reference characters are used for designating like parts throughout the several figures.

BEST MODE FOR CARRYING OUT THE INVENTION

Figure 1:
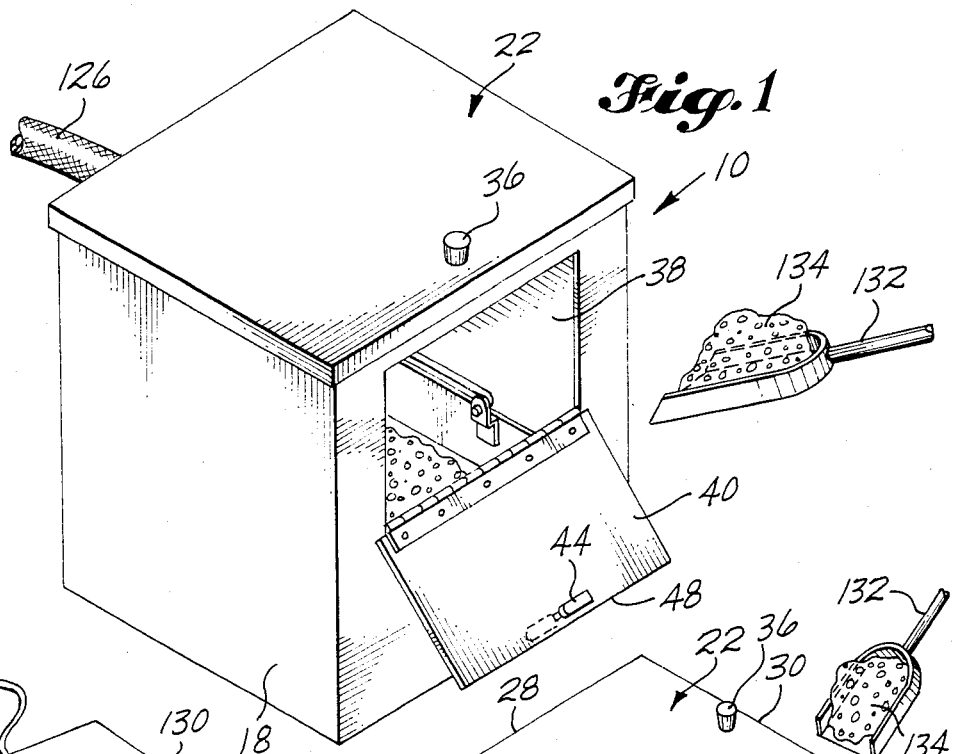
FIG. 1 is a pictorial view taken from above and looking down towards one side and the front of an ash collecting receptacle which embodies the principles of the present invention, showing the inlet door moved into an open position and further showing the scoop end portion of a ash shovel spaced outwardly from the inlet opening.

Referring to FIGS. 1–4, the receptacle 10 may take the form of a rectangular box, having a bottom 12, a front wall 14, a rear wall 16, a pair of sidewalls 18, 20 and a top door 22.

The top door 22 may include a panel 24 which is sized to completely cover the top opening in the receptacle 10, and edge walls 26, 28, 30, 32. The edge walls extend downwardly from the panel 24 and side lap the upper edge portions of the sidewalls 14, 16, 18, 20. A piano type hinge 34, or the like may be provided for hinge connecting one of the edge walls, e.g. edge wall 26, to a wall of the receptacle 10, e.g. backwall 16.

Figure 3:
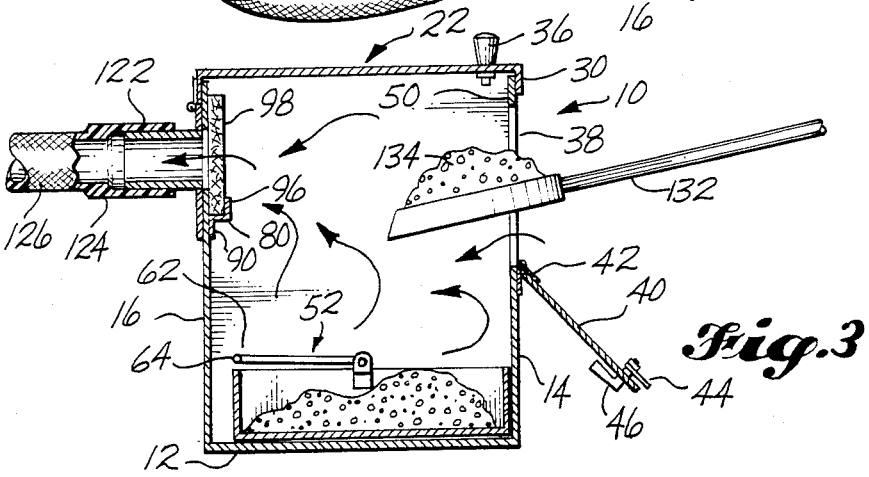
FIG. 3 is a vertical sectional view taken through the receptacle, showing the scoop end of the shovel moved part way through the inlet opening, showing the ash pan within the receptacle, and further showing an ash dust collecting filter mounted immediately inwardly of an opening in the rear wall of the receptacle, and showing an adaptor mounted on the opposite side of the rear wall of a type including a nipple which is in telescopic engagement with a fitting at the suction end of an accessory hose which leads from the tank portion of a conventional home vacuum cleaner, but with the vacuum cleaner omitted.

As best shown by FIG. 3, when the top 22 is closed, the lapping relationship of the edge walls 24, 26, 28, 30 with the receptacle walls 14, 16, 18, 20 effectively seals against ash dust leaking out around the edges of the cover 22. By way of typical and therefore nonlimitative example, the cover 22 may be provided with a knob-like handle 36 usuable for swinging the cover 22 between open and closed positions.

An inlet opening 38 is provided in what is herein referred to as the front wall 14. Opening 38 is preferably provided in an upper central portion of the wall 14. A cover 40 is provided for the inlet opening 38. Cover 40 may be hinge connected, such as by a piano hinge 42, or the like, to the portion of wall 14 which borders the lower edge of opening 38. Door 40 is shown to be provided with a rotatable latch-type lock 44, operable by a rotatable handle 46. The latch 44 is per se well known. It includes a latch member which is connected to the inner end of the handle shaft. When the handle 46 is rotated into a sideways position (FIG. 1) the latch member 44 is positioned inwardly from the edge 48 of door 40 a sufficient amount that the door 40 can be closed without interference by the latch member 44. Then, when the handle 46 is rotated back into the position shown by FIGS. 3 and 4, the latch member 44 projects upwardly into a position immediately bordering location 50 (FIG. 3). In this position the latch member 44 locks or latches the door 40 in its closed position.

Figure 4:
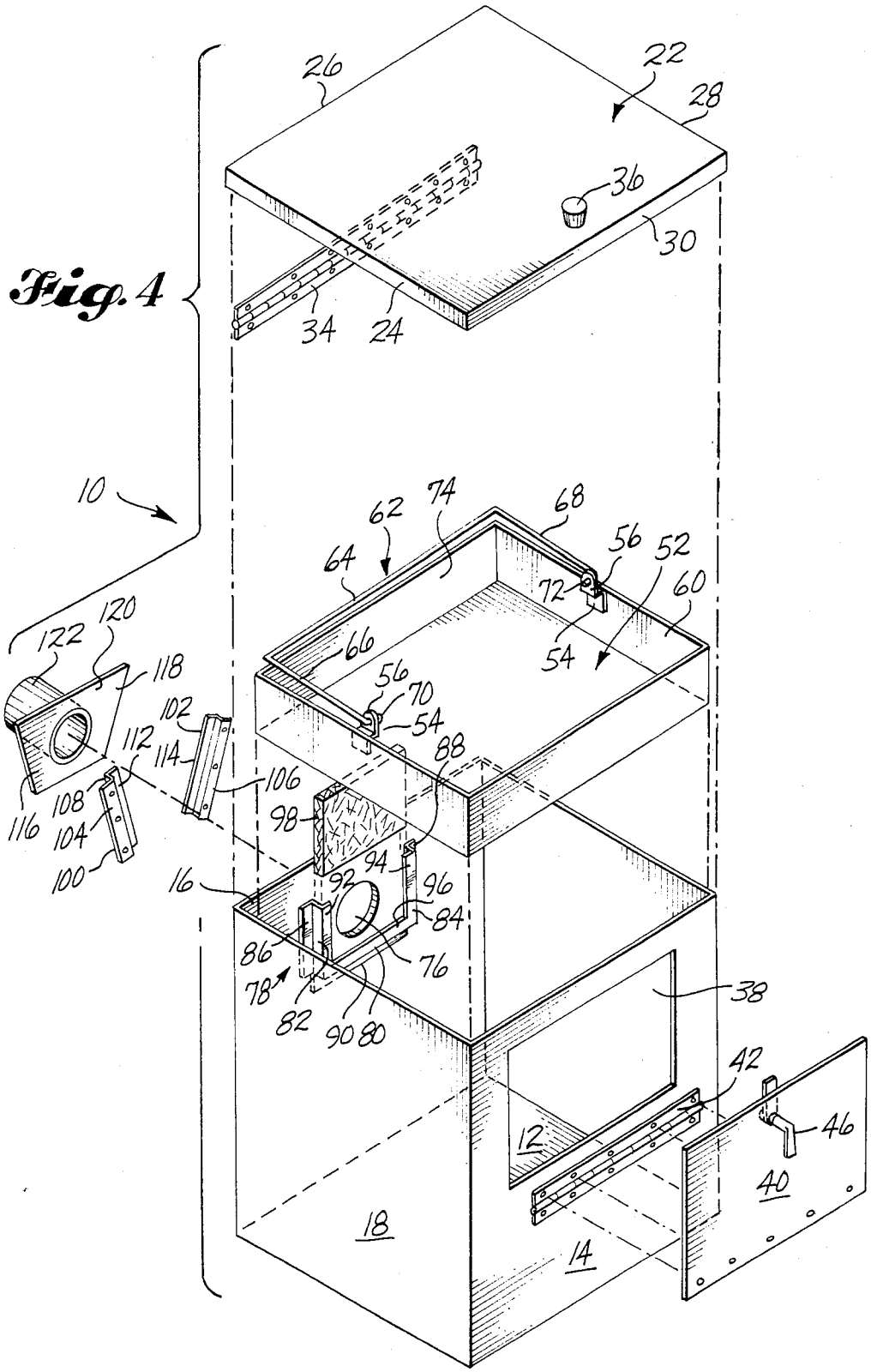
FIG. 4 is an exploded isometric view of the ash collecting receptacle of FIGS. 1–3.

According to an aspect of the invention, a rectangular ash collecting pan 52 is insertable into the receptacle 10. As shown by FIGS. 3 and 4, the ash pan 52 is sized to be snugly received within the lower portion of the receptacle 10. Ash pan 52 includes a suitable handle structure for use in setting it into and removing it from the receptacle 10. By of example, a pair of handle mounts 54, including offset ears 56, are secured to central inside regions of pan walls 58, 60. The handle is in the form of a generally U-shaped rod 62. Handle 62 includes top section 64 and two side sections 66, 68. The lower ends of the side sections 66, 68 are bent inwardly, to provide hinge pins 70, 72, which are insertable through openings provided in the ears 56. As shown by FIGS. 3 and 4, the handle 62 can be swung off into a position wherein it substantially lies down on upper edge portions of the walls 58, 60, 74. Then when needed, the handle portions 64 is grasped by the hand of the user and used for swinging the handle up into a vertical position. The offset nature of the ears 56 locates the side sections 66, 68 essentially vertically above the upper edges of the walls 58, 60.

As shown by FIG. 3, when the ash pan 52 is located inside the receptacle 10, and the handle 62 is folded down, the handle 62 does not interfere with ash introduction into the pan 52.

In accordance with an important aspect of the invention, one wall of the receptacle 10 is formed to include an opening 76. A filter holder 78 is provided on the inside of such wall, generally about the opening 76. The filter holder may comprise a bottom portion 80 and two side portions 82. Filter holder 78 may be constructed from a single piece of sheet metal which has been cut and bent into the configuration shown by FIG. 4. The side portions 82, 84 comprise mounting flanges 86, 88. The lower portion 80 includes a similar flange 90. The flanges 86, 88, 90 are welded or otherwise secured to the receptacle wall 16. Side portions 82, 84, and lower portion 80 include wall portions which project perpendicular from walls 86, 88, 90. They also include retainer lips 92, 94, 96. Together, these walls include a pocket for receiving the edge portions of filter block 98. When filter block 98 is positioned down inside the holder 78, it completely blocks the opening 76 (FIG. 3).

Preferably, filter block 98 is a fibrous filter. It may be a random fiber-type filter of the type which is commonly used in furnaces to filter fine pieces of dust out of the air which is circulated through the furnace. However, any suitable filter material for removing fine particles from a moving air current, without seriously impeding current flow, could be used for the filter block 98. Filter block 98 may be constructed from a fibrous material of a type which can take and hold an electrostatic charge, so that the dust particles can be electrostatically removed from the air current.

Figure 2:
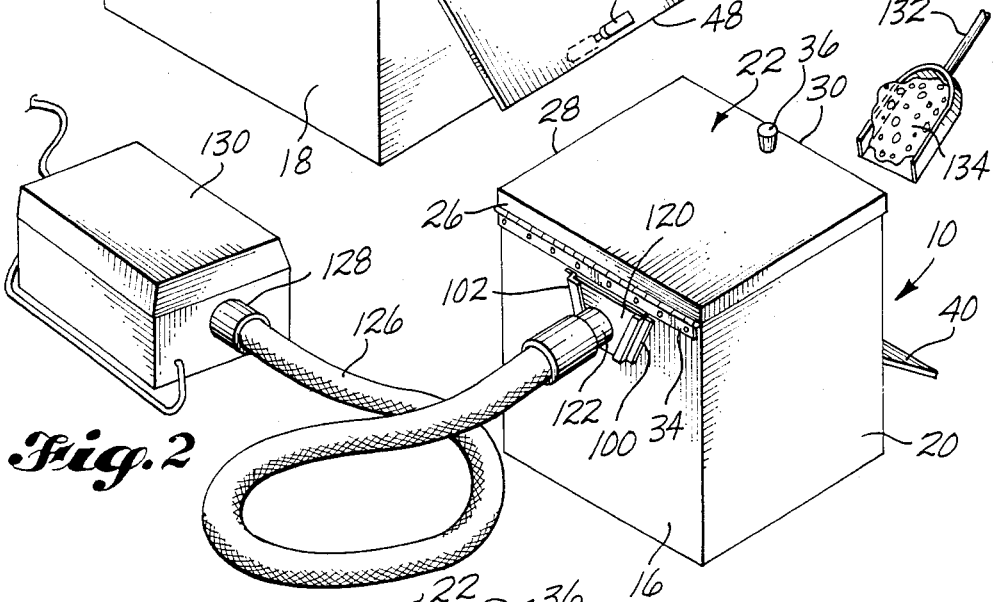
FIG. 2 is a view like FIG. 1, but on a smaller scale, and looking toward the rear of the receptacle, such view showing a conventional home type vacuum cleaner connected to the receptacle, at a location across the receptacle from the inlet opening.

In preferred form, a second mount is provided on the opposite of wall 16. This mount may comprise a pair of side members 100, 102, each formed from a single piece of sheet material and each including a mounting base 104, 106, a sidewall 108, 110 and a retainer lip 112, 114. As best shown by FIG. 2, the members 100, 102 are secured to wall 16 in such a manner that they angle towards each other, from top to bottom. The sidewalls 108, 110 and the lips 112, 114 define retainer pockets for the opposite edge portions 116, 118 of a trapezoidal mounting plate 120. Plate 120 carries a nipple 122. When adaptor plate 120 is set down into its mount 100, 102, the nipple 122 is in alignment with opening 76 in wall 16. Nipple 122 projects outwardly from plate 120.

Nipple 122 is sized to be telescopically connectable to an end fitting 24 carried at the suction end of a vacuum cleaner suction hose 126. The opposite end 128 of hose 126 is connected to the inlet of a vacuum cleaner tank 130.

In use, the cover 22 is closed, the front door 40 is opened. A scoop shovel 132 is used for scooping up a quantity of ash 134, from the firebox of a stove or fireplace (not shown). The vacuum cleaner is turned on, so that a suction will exist at filter 98. The scoop of ash 134 is then moved through the inlet opening 38 and deposited into the ash pan 52. This will cause some dust to rise within the receptacle 10. However, the rising dust will immediately be brought under influence of the suction and will be drawn towards the filter 98. Once the ash pan 52 has been filled, or the firebox has been cleaned, which ever occurs first, the door 40 is closed and locked. When sufficient time has been allowed for all of the dust to be collected at the filter 98 or sucked into the vacuum cleaner 130, the top panel 22 is swung open. The attendant then inserts his or her hand down through the open top of the receptacle 10, grasp the top bar 64 of handle 62, swings the handle upwardly into a vertical position, and then pulls upwardly on the handle to remove the ash pan 52 from the receptacle 10.

As will be evident, the receptacle 10 can be used over and over again. The filter 98 can be easily removed and discarded when dirty. And, another filter can be easily inserted in its place. During periods of non use, the adaptor 120, 122 can be easily slipped out of its holder 100, 102 and set inside the receptacle 10. The receptacle 10 can be provided with a decorative exterior, giving it a pleasing appearance, and enabling it to be an ornament for the fireplace or stove region.

What is claimed is:

1. An ash collecting receptacle having wall means designed to form a substantially closed chamber having a side located inlet opening;

an ash collector pan in a lower portion of the receptacle, said pan having a bottom and sidewalls, and a handle;

said receptacle including a sidewall opening spaced from the inlet opening;

means mounting a filter member over the inside of said sidewall opening;

means on the opposite side of the opening for receiving a suction hose leading from a conventional vacuum cleaner;

whereby the vacuum cleaner can be turned on and used for causing airflow to the filter, so that during ash introduction through the inlet opening into the ash pan within the receptacle, the ash dust will rise and be influenced by the suction provided by the vacuum cleaner towards the filter member, and will be collected by the filter member or drawn into the vacuum cleaner;

wherein the means mounting a filter member comprises means on diametrically opposite sides of the sidewall opening which with said sidewall defines channels opening towards each other;

wherein the filter comprises a body of fibrous material having opposite edge portions which are received in the channels; and wherein the means for receiving a suction hose comprising a sheet metal base member having edge portions and a central opening, a tube connected to the base member generally about the opening and projecting from the base member, and means on diametrically opposite sides of the sidewall opening which together with the sidewall defines a pair of channels opening towards each other, with edge portions of the base member being receivable in said channels.

2. An ash collecting receptacle according to claim 1, wherein the inlet opening and the sidewall openings are in opposite walls of the receptacle.

3. An ash collecting receptacle having wall means designed to form a substantially closed chamber having a side located inlet opening;

an ash collector pan in a lower portion of the receptacle, said pan having a bottom and sidewalls, and a handle;

said receptacle including a sidewall opening spaced from the inlet opening;

means mounting a filter member over the inside of said sidewall opening;

means on the opposite side of the opening for receiving a suction hose leading from a conventional vacuum cleaner, whereby the vacuum cleaner can be turned on and used for causing airflow to the filter, so that during ash introduction through the inlet opening into the ash pan within the receptacle, the ash dust will rise and be influenced by the suction provided by the vacuum cleaner towards the filter member, and will be collected by the filter member or drawn into the vacuum cleaner;

a top lid which can be opened so that the ash collector pan can be moved out from the top of the receptacle;

wherein the ash pan has four sidewalls;

wherein the handle comprises two side members and an interconnecting top member, and wherein the side members include lower ends which are pivotally attached to central portions of a pair of opposed ash collector pan sidewalls, wherein the handle is pivotal between the folded position in which it is substantially down on upper edge portions of the ash collector pan sidewalls, and an in use position in which it extends generally vertically upwardly from the ash collector pan;

wherein the means mounting a filter member comprises means on diametrically opposite sides of the sidewall opening which with said sidewall defines channels opening towards each other;

wherein the filter comprises a body of fibrous material having opposite edge portions which are received in the channels; and wherein the means for receiving a suction hose comprising a sheet metal base member having opposite edge portions and a central opening, a tube connected to the base member generally about the opening and projecting from the base member, and means on diametrically opposite sides of the sidewall opening which together with the sidewall defines a pair of channels opening towards each other, with edge portions of the base member being receivable in said channels.

4. An ash collecting receptacle according to claim 3, wherein the inlet opening and the sidewall openings are in opposite walls of the receptacle.

5. An ash collecting receptacle comprising wall means designed to form a substantially closed chamber having a first sidewall including an inlet opening;

an ash collector pan in a lower portion of the receptacle, said pan having a bottom and four sidewalls, and a handle comprising two side members and an interconnecting top member and wherein the side members include lower ends which are pivotally attached to central portions of a pair of opposed ash collector pan sidewalls, and wherein the handle is pivotal between the folded position in which it is substantially down on upper edge portions of the ash collector pan sidewalls, and an in use position in which it extends generally vertically upwardly from the ash collector pan;

said receptacle including a second sidewall opposite the first sidewall and including a sidewall opening;

means mounting a filter member in the form of a body of fibrous material over the inside of said sidewall opening;

tube means on the opposite side of the sidewall opening for receiving a suction hose leading from a conventional vacuum cleaner;

whereby the vacuum cleaner can be turned on and used for causing airflow to the filter, so that during ash introduction through the inlet opening into the ash pan within the receptacle, the ash dust will rise and be influenced by the suction provided by the vacuum cleaner towards the filter member, and will be collected by the filter member or drawn into the vacuum cleaner; and said receptacle further including a top lid which can be opened so that the ash collector pan can be moved out from the top of the receptacle.

* * * * *